US006898856B2

(12) United States Patent
Mak et al.

(10) Patent No.: US 6,898,856 B2
(45) Date of Patent: May 31, 2005

(54) LETTER OPENER

(76) Inventors: King Biu Mak, Rm. A12, 5/F., Block A2, Yau Tong Industrial City, 17 Ko Fai Road, Yau Tong, Kowloon (HK); Chung Yin Ronald Mak, Rm. A12, 5/F., Block A2, Yau Tong Industrial City, 17 Ko Fai Road, Yau Tong, Kowloon (HK); Chung Ming Mak, Rm. A12, 5/F., Block A2, Yau Tong Industrial City, 17 Ko Fai Road, Yau Tong, Kowloon (HK)

( * ) Notice: Subject to any disclaimer, the term of this patent is extended or adjusted under 35 U.S.C. 154(b) by 0 days.

(21) Appl. No.: 10/686,739

(22) Filed: Oct. 17, 2003

(65) Prior Publication Data

US 2005/0081390 A1 Apr. 21, 2005

(51) Int. Cl.[7] ..... B26B 29/00
(52) U.S. Cl. ..... 30/294; 30/DIG. 3

(58) Field of Search ..... 30/DIG. 3, 293, 30/294, 2, 289

(56) References Cited

U.S. PATENT DOCUMENTS 1,216,889 A * 2/1917 Todd ..... 30/289
2,388,695 A * 11/1945 Kriewaldt ..... 30/289
3,142,119 A * 7/1964 O'Brien ..... 30/278

* cited by examiner

*Primary Examiner*—Douglas D Watts
(74) *Attorney, Agent, or Firm*—Burns, Doane, Swecker & Mathis, L.L.P.

(57) ABSTRACT

A letter opener is disclosed as including a body with a channel allowing an envelope to pass through, and a cutting blade extending into the channel, in which the body and the cutting blade are movable relative to each other to vary the position along the channel at which the cutting blade cuts the passing envelope. At least part of the channel is of a generally S shape.

11 Claims, 13 Drawing Sheets

LETTER OPENER

This invention relates to a letter opener, which may be manually operated or electrically operated.

BACKGROUND OF THE INVENTION

Various letter openers, either manually operable or electrically operable, have been available for assisting in opening letters. Such letter openers usually include a straight slot through which an envelope may slide. For a manually operated letter opener, a cutting blade is positioned to extend into the slot to cut open the envelope as the envelope passes through the slot. As to electrically operated letter openers, as the envelope enters or passes through the slot, a switch will be activated to actuate a rotary cutter to rotate to cut the envelope.

It is of course the case that different envelopes may have different thickness. A shortcoming associated with such conventional letter openers is that the depth to which the cutting blade or rotary cutter cuts into the envelope cannot be adjusted by the user to cater for the differences in the thickness of the envelopes.

In addition, it is also known that envelopes are usually pressed tightly during transport. This will increase the difficulty in cutting the envelopes, so that sometimes an envelope has to undergo the cutting process more than once, and sometimes the envelope may simply be torn open, and not cut open, thus damaging the envelope and possibly the content as well.

It is thus an object of the present invention to provide a letter opener in which the aforesaid shortcomings are mitigated, or at least to provide a useful alternative to the public.

SUMMARY OF THE INVENTION

According to a first aspect of the present invention, there is provided a letter opener including a body member with a channel allowing an envelope to pass through, and a cutting member extending into said channel, wherein said body member and said cutting member are movable relative to each other to vary the position along said channel at which said cutting member cuts said passing envelope.

According to a second aspect of the present invention, there is provided a letter opener including a body member with a channel allowing an envelope to pass through, and a cutting member extending into said channel, wherein at least part of said channel is of a generally S shape.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
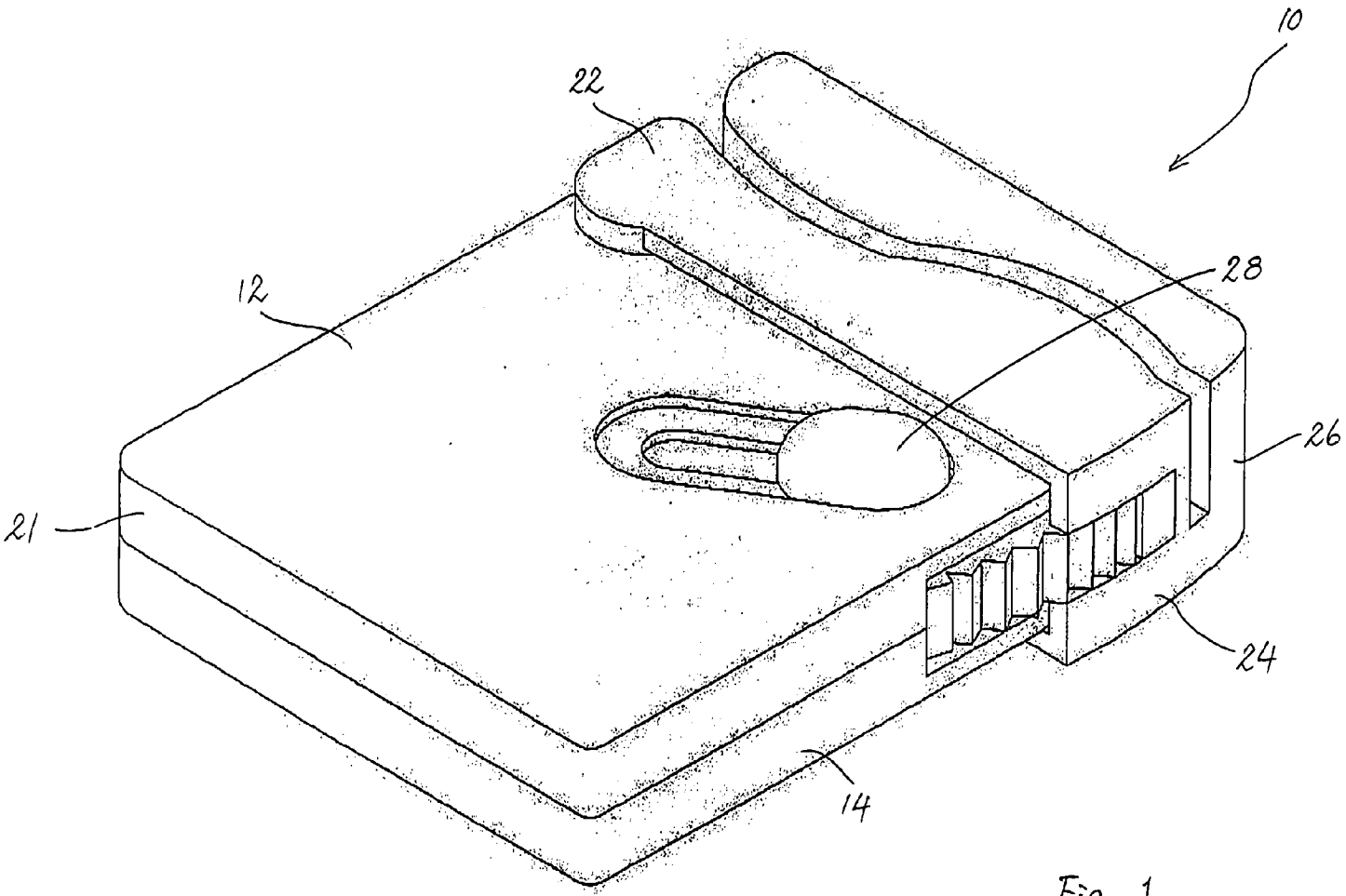
FIG. 1 is a perspective view of a letter opener according to a preferred embodiment of the present invention.
Figure 2:
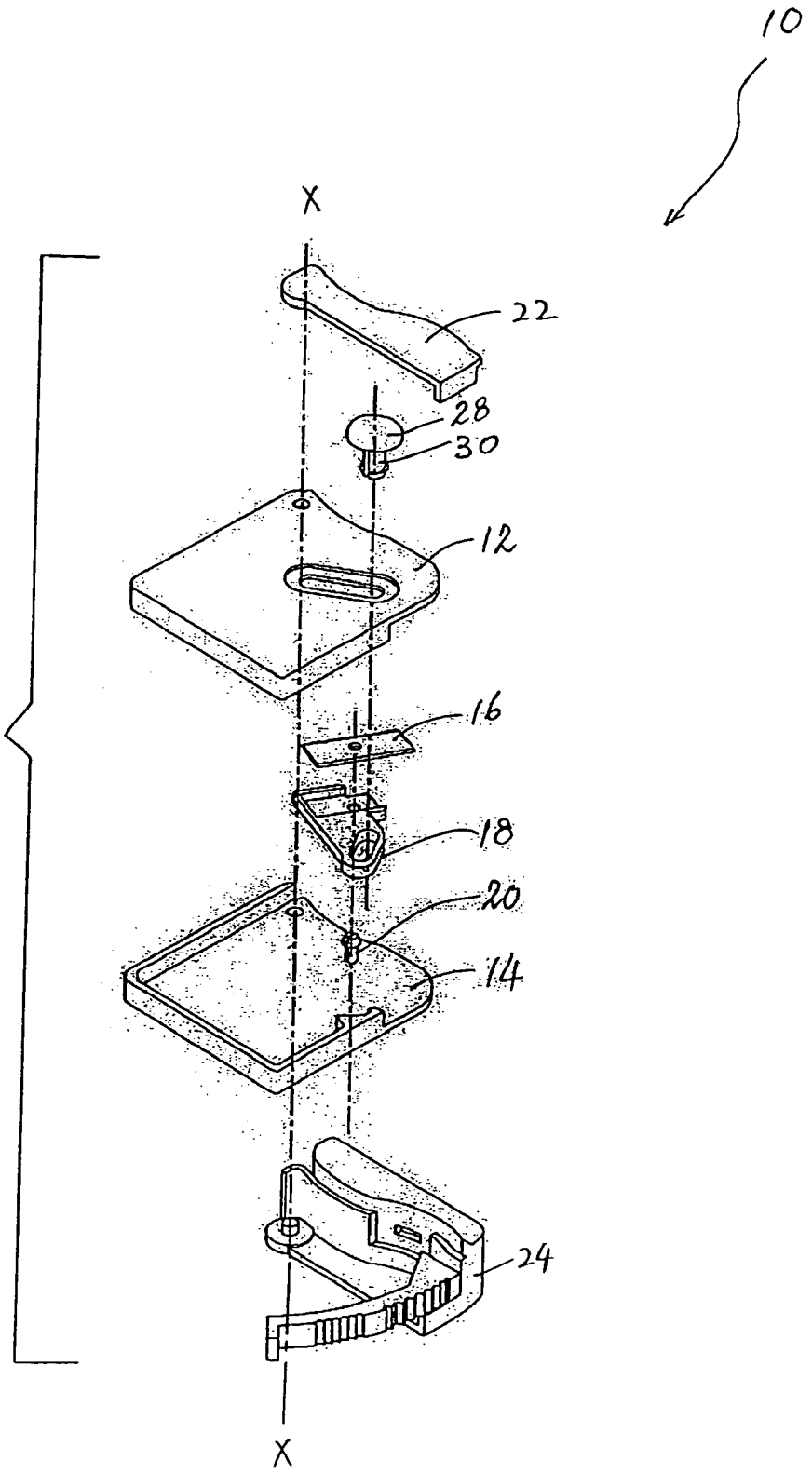
FIG. 2 is an exploded view of the letter opener shown in FIG. 1.
Figure 3C:
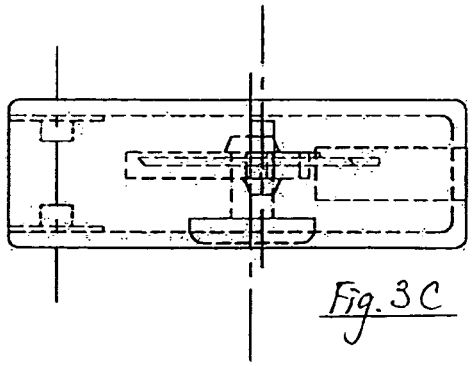
FIG. 3C is a top view of the letter opener shown in FIG. 1.
Figure 3A:
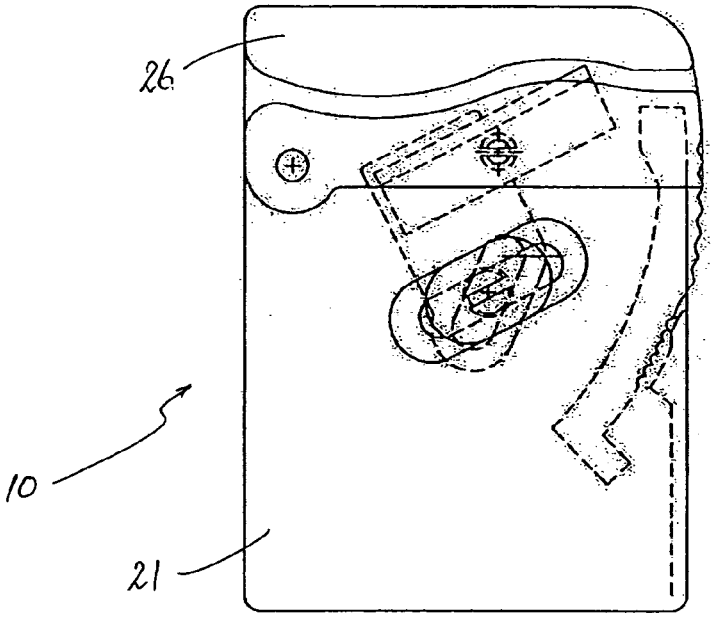
FIG. 3A is a front view of the letter opener shown in FIG. 1.
Figure 3B:
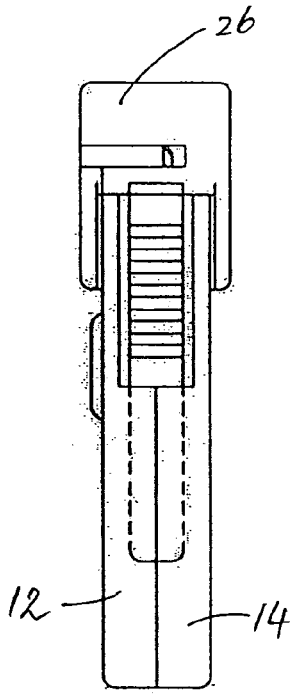
FIG. 3B is a right side view of the letter opener shown in FIG. 1.
Figure 3D:
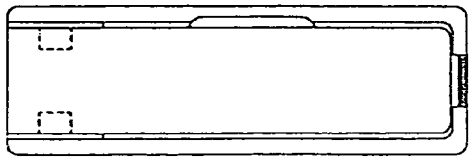
FIG. 3D is a bottom view of the letter opener shown in FIG. 1.
Figure 3E:
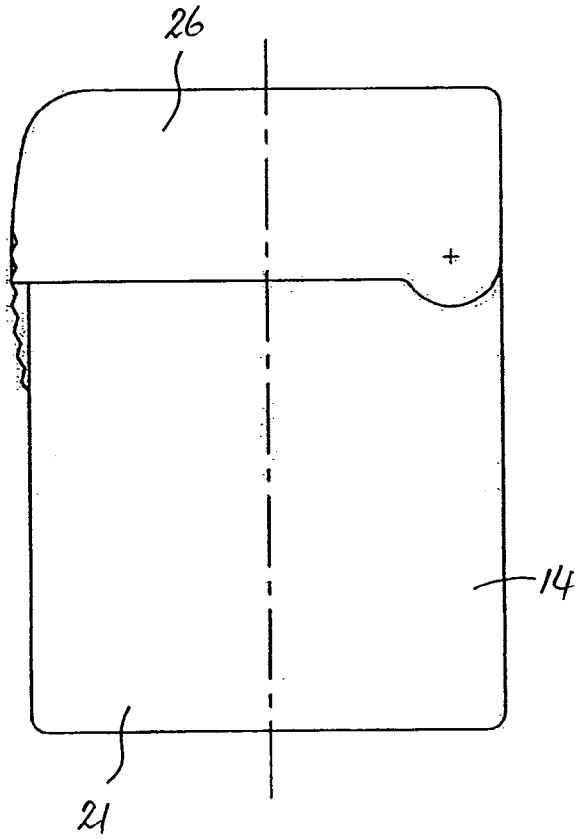
FIG. 3E is a rear view of the letter opener shown in FIG. 1.
Figure 3F:
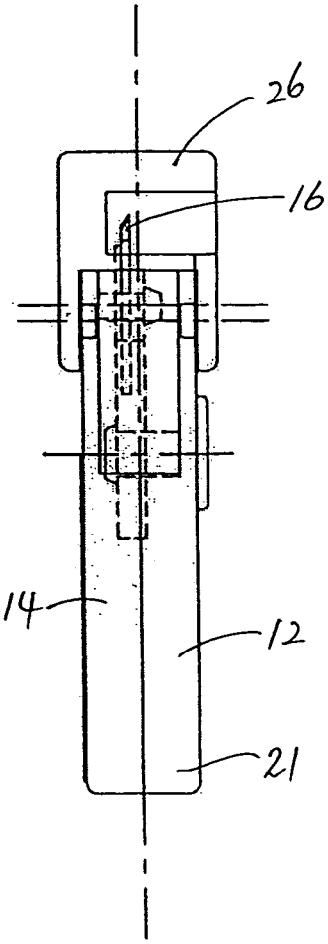
FIG. 3F is a left side view of the letter opener shown in FIG. 1.

A letter opener according to a preferred embodiment of the present invention is shown in FIG. 1, and generally designated as 10. As can be seen in FIGS. 1 to 3F, the letter opener 10 includes a front cover 12 secured with a rear cover 14 to enclose a cutting blade 16 mounted to a cutting blade carrier 18 by a screw 20. The front cover 12 and the rear cover 14 combine to form a main body part 21 of the letter opener 10. A front head part 22 and a rear head part 24 are engaged with each other to form a head portion 26, which is swivellably movable relative to the main body part 21 about an axis X—X. A button 28 with a pin 30 is provided for moving the cutting blade carrier 18 and the cutting blade 16 mounted thereto, in a manner to be discussed below.

Figure 4:
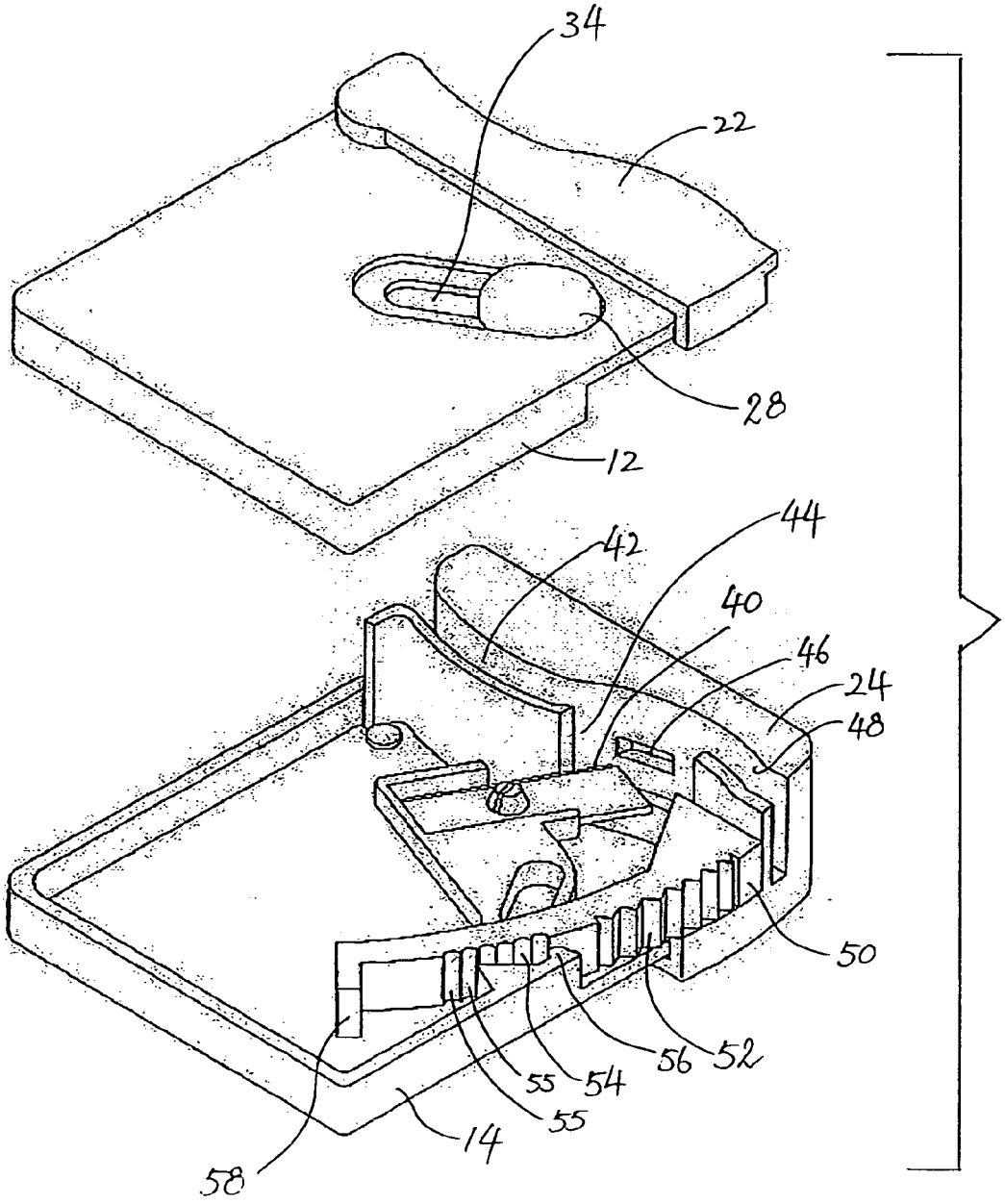
FIG. 4 is a partial exploded view of the letter opener shown in FIG. 1.
Figure 5:
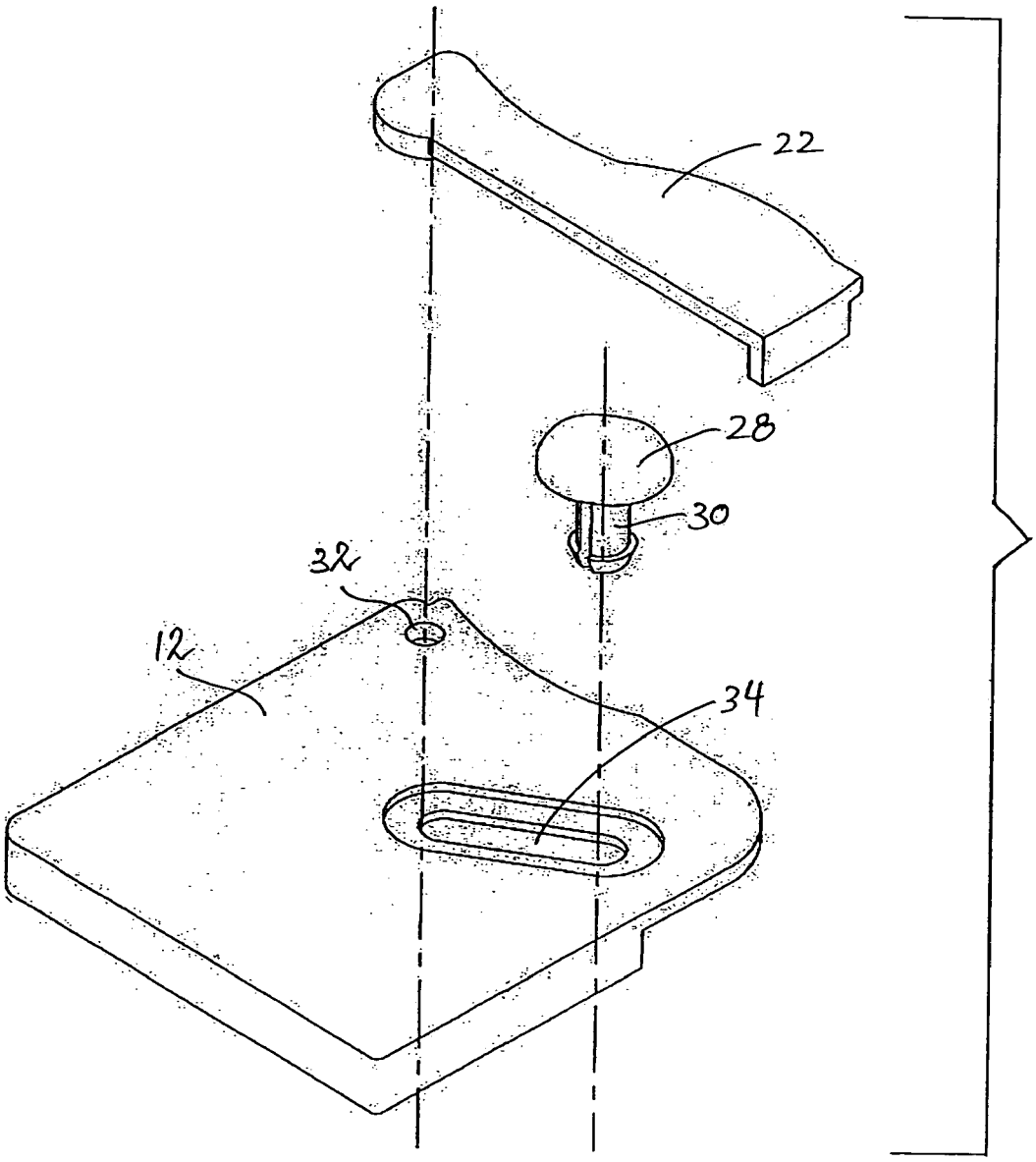
FIG. 5 is an exploded view of the front part of the letter opener shown in FIG. 1.

As can be seen in FIGS. 4 and 5, the front cover 12 includes a hole 32 for receiving a pin (not shown) extending from an underside of the front head part 22, thus allowing the front cover 12 and the front head part 22 to swivellably move relative to each other. The pin 30 of the button 28 extends through an elongate slot 34 of the front cover 12, thus allowing the button 28 to slide along the slot 34, and thus relative to the front cover 12.

Figure 6:
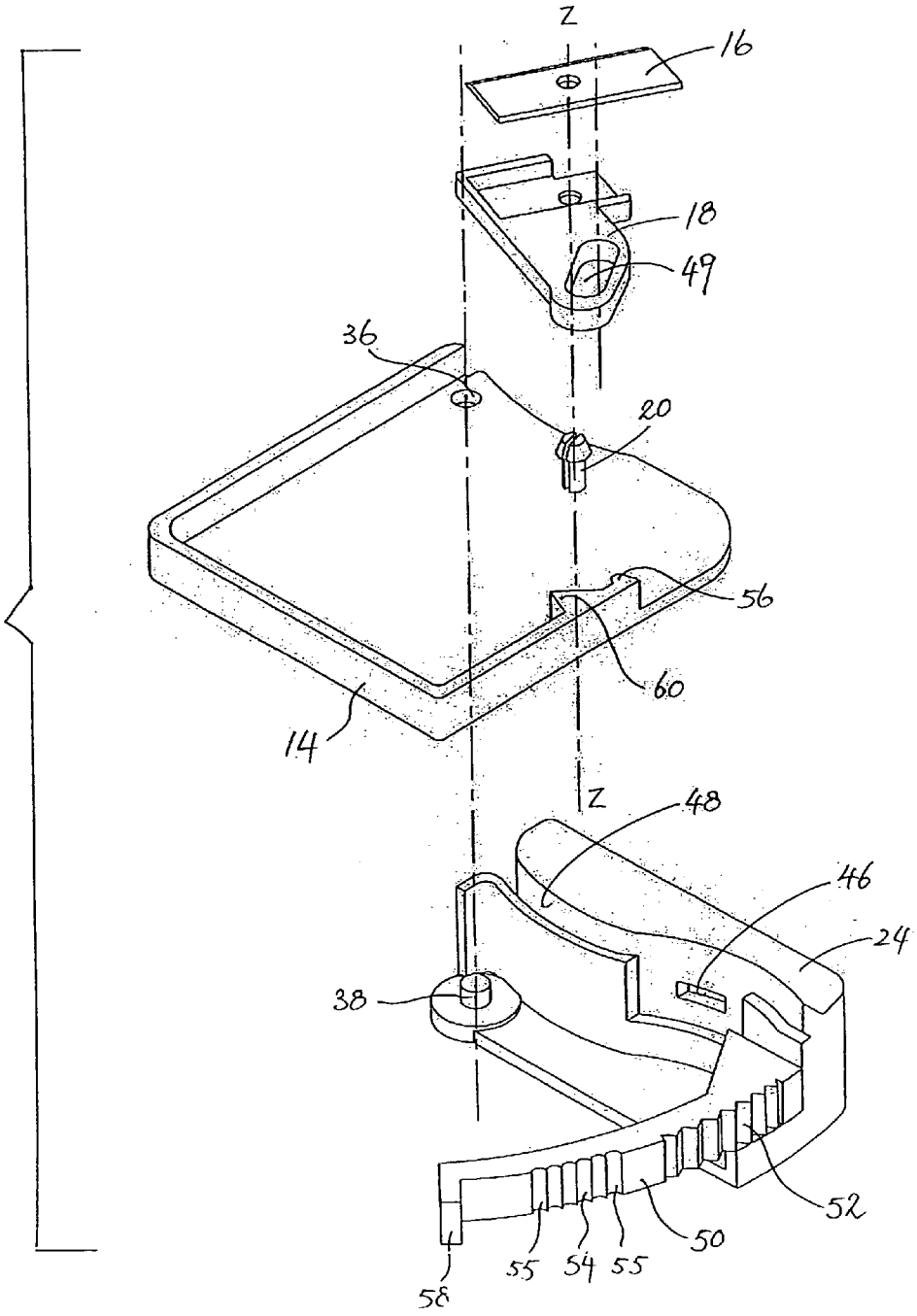
FIG. 6 is an exploded view of the rear part of the letter opener shown in FIG. 1.

Referring now to FIGS. 4 and 6, the rear cover 14 has a hole 36 for receiving a pin 38 extending from the rear head part 24, thus allowing the rear cover 14 and the rear head part 24 to swivellably move relative to each other. As can be seen more clearly in FIG. 4, when the cutting blade 16 and carrier 18 are assembled with the rear cover 14, the cutting edge 40 of the cutting blade 16 extends into a channel 42 of the rear head part 24 through an opening 44. A rectangular recess 46 is provided on a wall 48 opposite the cutting blade 16, to receive part of the cutting blade 16 when the cutting blade 16 is at the position shown in FIGS. 9A and 10, to be further discussed below.

When the letter opener 10 is properly assembled, the pin 30 of the button 28 also extends through an elongate slot 49 of the carrier 18. By way of such an arrangement, movement of the button 28 along the slot 34 will bring about a swivelling movement of the cutting blade carrier 18, and thus the cutting blade 16 mounted thereto, about axis Z—Z shown in FIG. 6. It can also be seen in FIGS. 4 and 5 that a leg 50 extends from the rear head part 24. When the letter opener 10 is assembled as shown in FIG. 4, the leg 50 extends into the cavity formed between the front cover 12 and the rear cover 14. The leg 50 includes a first corrugated surface 52 for enhancing engagement between a user's digit, e.g. thumb, and the leg 50. The leg 50 also includes a second corrugated surface 54 with a number of recesses 55 with which a protruding part 56 may engage, for releasably maintaining the head portion 26 relative to the body part 21 at one of a number of different positions. At the distal end of the leg 50 is a toe 58 which may be moved to abut a ledge 60 of the rear cover 14 for preventing the leg 50 from being moved out of the cavity formed between the front cover 12 and the rear cover 14, thus limiting the extent of movement of the head portion 26 relative to the body part 21.

Figure 7A:
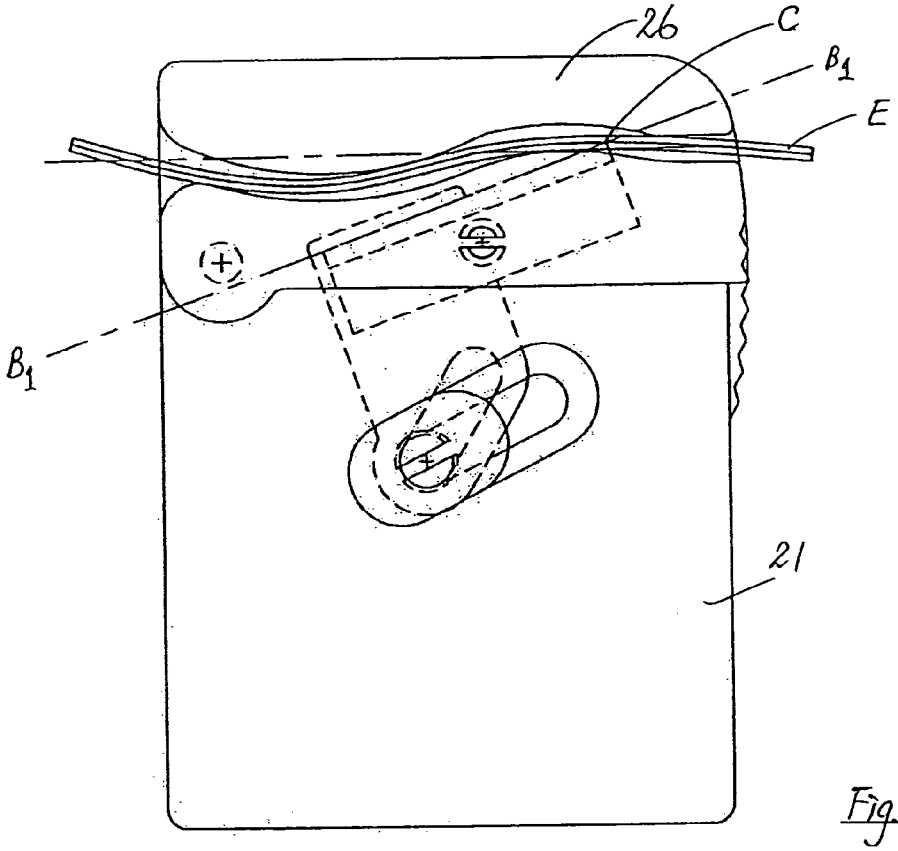
FIG. 7A is a top view of the letter opener shown in FIG. 1, with the cutting blade in the lowermost position.
Figure 7B:
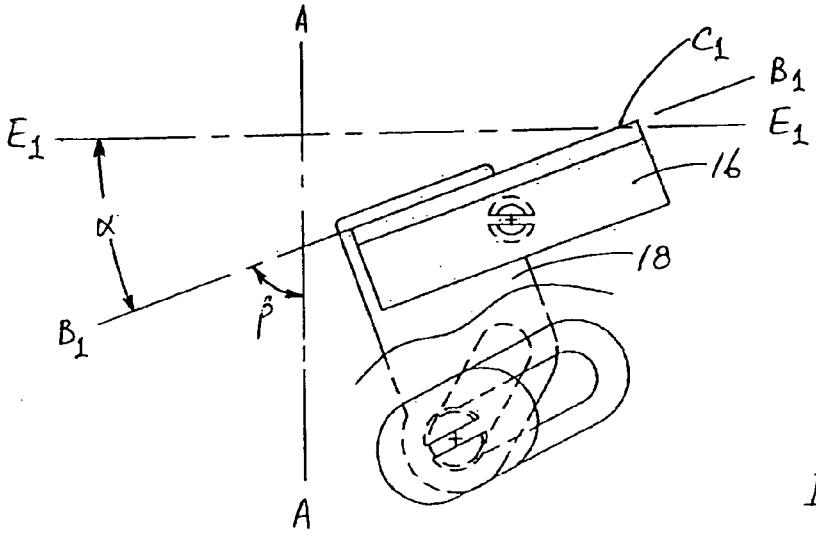
FIG. 7B shows the positional relationship of the cutting blade in FIG. 7A and a letter being cut.
Figure 8A:
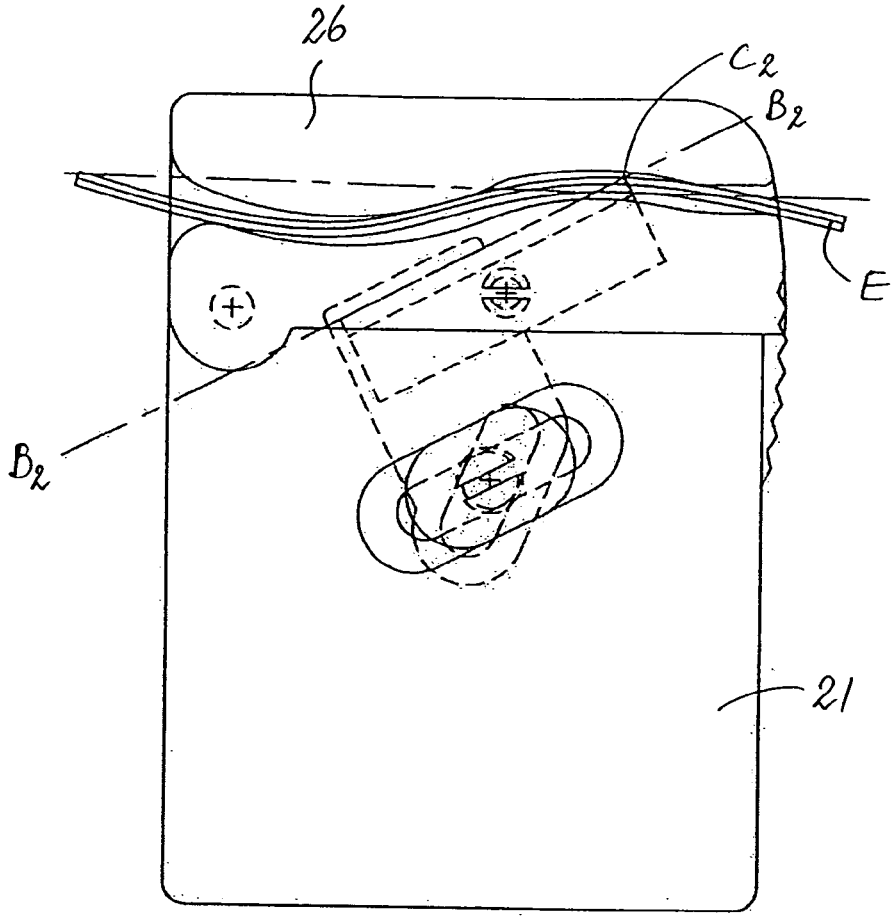
FIG. 8A is a top view of the letter opener shown in FIG. 1, with the cutting blade in the midway position.
Figure 8B:
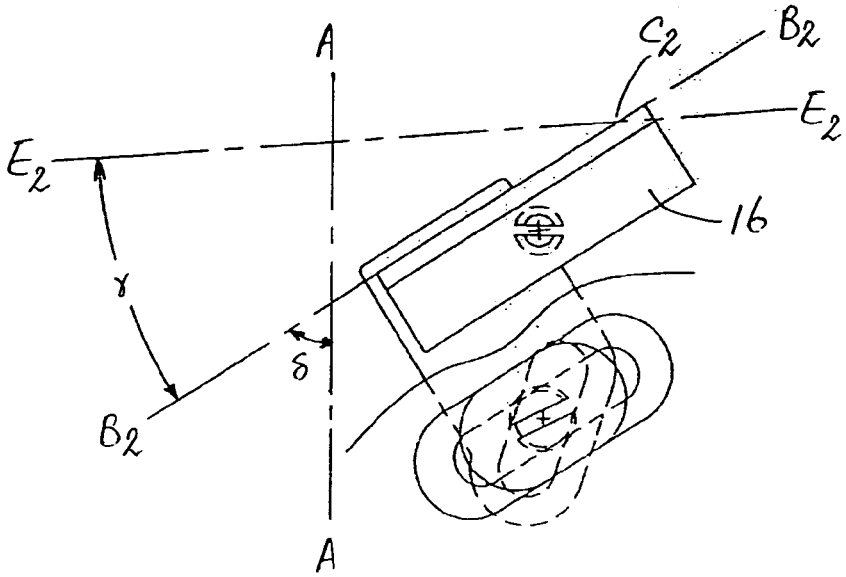
FIG. 8B shows the positional relationship of the cutting blade in FIG. 8A and a letter being cut.
Figure 9A:
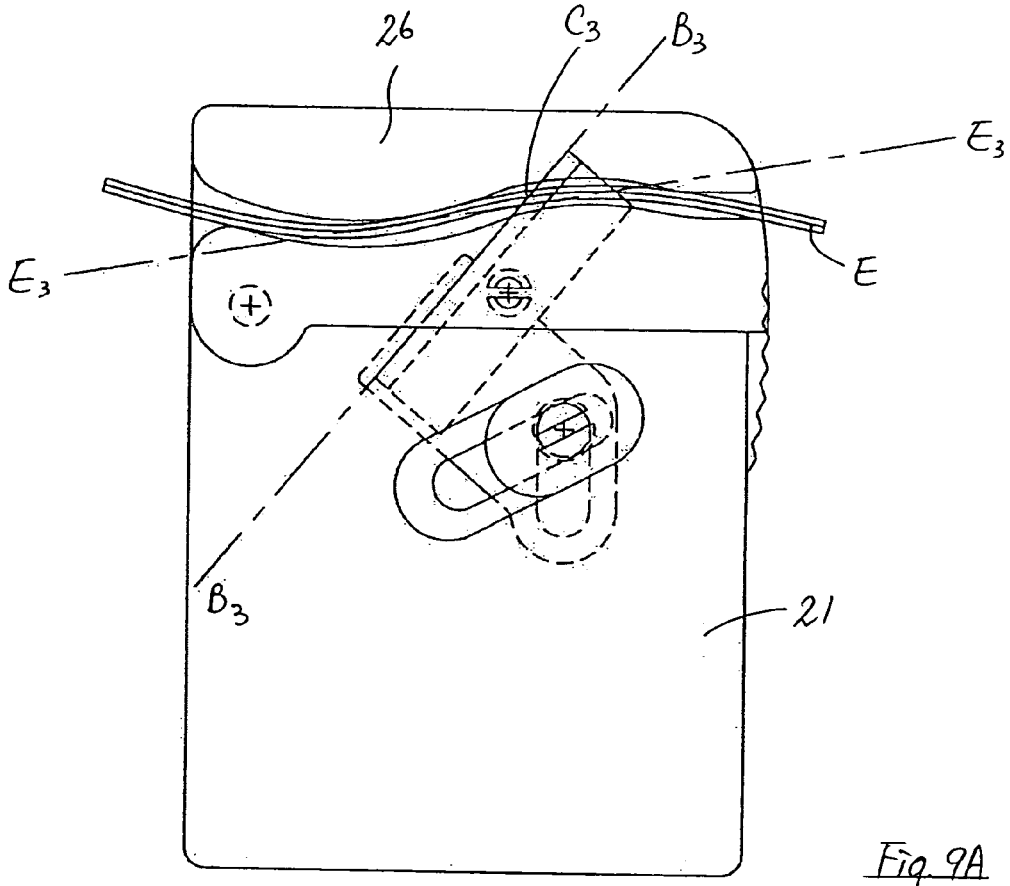
FIG. 9A is a top view of the letter opener shown in FIG. 1, with the cutting blade in the uppermost position.
Figure 9B:
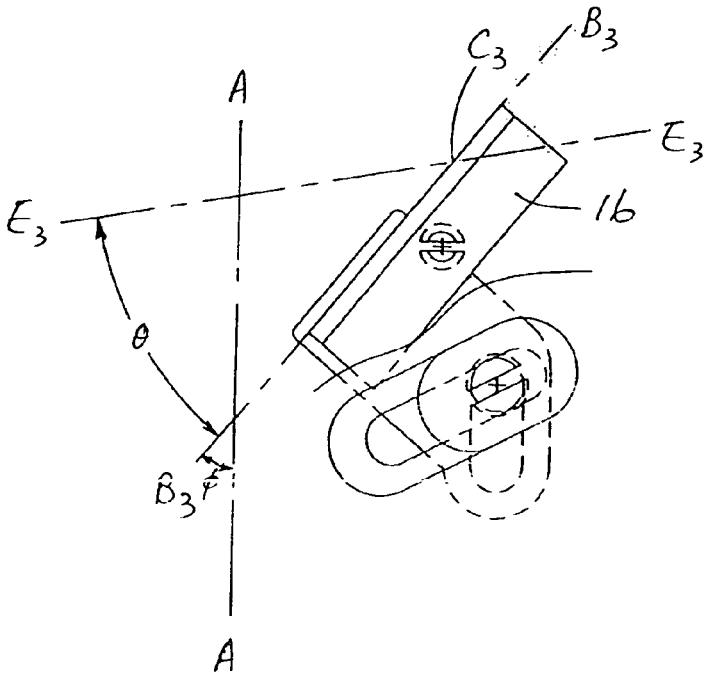
FIG. 9B shows the positional relationship of the cutting blade in FIG. 9A and a letter being cut.

The button 28 may be moved by a user to move the carrier 18, and thus the cutting blade 16, between the position shown in FIGS. 7A and 7B, the position shown in FIGS. 8A and 8B, and the position shown in FIGS. 9A and 9B.

In the configuration as shown in FIGS. 7A and 7B, the cutting blade 16 is at its lowermost position relative to the body part 21. It can be seen that the channel 42 is of a generally S shape, and the channel 42 bends away from the cutting blade 16 adjacent the position $C_1$ where the cutting blade 16 cuts a passing envelope E. It is found in practice that when the envelope E passes through the channel 42, its tension will be eased out by reason of the shape of the channel 42, thus facilitating cutting of the envelope E by the cutting blade 16.

As shown more clearly in FIG. 7B, the line $E_1$—$E_1$ is the tangent to the envelope E at the position $C_1$ where the cutting blade 16 cuts the envelope E, the line $B_1$—$B_1$ is parallel to the longitudinal axis of the cutting blade 16, and the line A—A is parallel to the longitudinal axis of the body part 21.

Turning now to FIGS. 8A and 8B, the cutting blade 16 is moved to its midway position relative to the body part 21 by moving the button 28. It can be seen that the cutting blade 16 extends further into the channel 42 than in the case of the configuration as shown in FIGS. 7A and 7B. In addition, it can also be seen that the cutting blade 16 has also been swivelled in an anti-clockwise position, so that (a) the angle $\delta$ between the line A—A and the line $B_2$—$B_2$, which is parallel to the longitudinal axis of the cutting blade 16, is smaller than the angle $\beta$ between the lines A—A and $B_1$—$B_1$ shown in FIG. 7B; and (b) the angle $\gamma$ between the line $B_2$—$B_2$ and the line $E_2$—$E_2$, which is the tangent to the envelope E at the position $C_2$ where the cutting blade 16 cuts the envelope E, is larger than the angle $\alpha$ between the lines $B_1$—$B_1$ and $E_1$—$E_1$.

Turning now to FIGS. 9A and 9B, the cutting blade 16 is moved further to adjacent its uppermost position relative to the body part 21. It can be seen that the cutting blade 16 extends still further into the channel 42 than in the case of the configuration as shown in FIGS. 8A and 8B. In fact, part of the cutting blade 16 extends into the recess 46 on the wall 48. It can also be seen that the cutting blade 16 has also been further swivelled in an anti-clockwise position, so that (a) the angle $\phi$ between the line A—A and the line $B_3$—$B_3$, which is parallel to the longitudinal axis of the cutting blade 16, is smaller than the angle $\delta$ between the lines A—A and $B_2$—$B_2$ shown in FIG. 8B; and (b) the angle $\theta$ between the line $B_3$—$B_3$ and the line $E_3$—$E_3$, which is the tangent to the envelope E at the position $C_3$ where the cutting blade 16 cuts the envelope E, is larger than the angle $\gamma$ between the lines $B_2$—$B_2$ and $E_2$—$E_2$.

It can be seen that, by way of the above-mentioned arrangement, a user may move the button 28 to move the cutting blade 16 so as to vary the position along the channel 42 at which the cutting blade 16 cuts the passing envelope E.

In FIGS. 7A to 9B discussed above, the head portion 26 is shown as in the same position relative to the body part 21. Relative movement between the head portion 26 and the body part 21 will now be discussed, by reference to FIGS. 10 to 12. In these figures, the cutting blade 16 is shown at its uppermost position relative to the body part 21.

Figure 10:
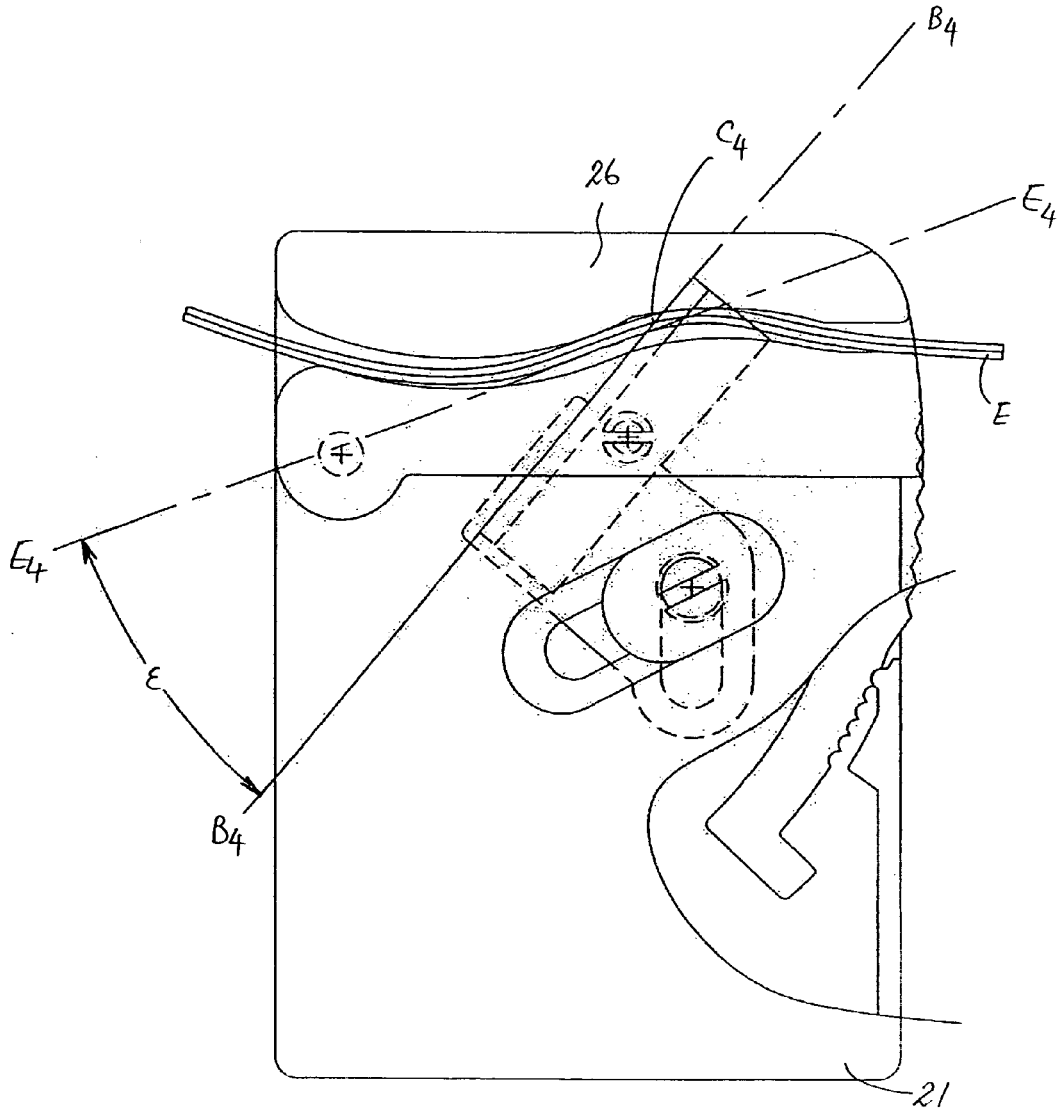
FIG. 10 is a top view of the letter opener shown in FIG. 1, with the head portion in a first position, and with part of the front part removed for showing the interior of the letter opener.
Figure 11:
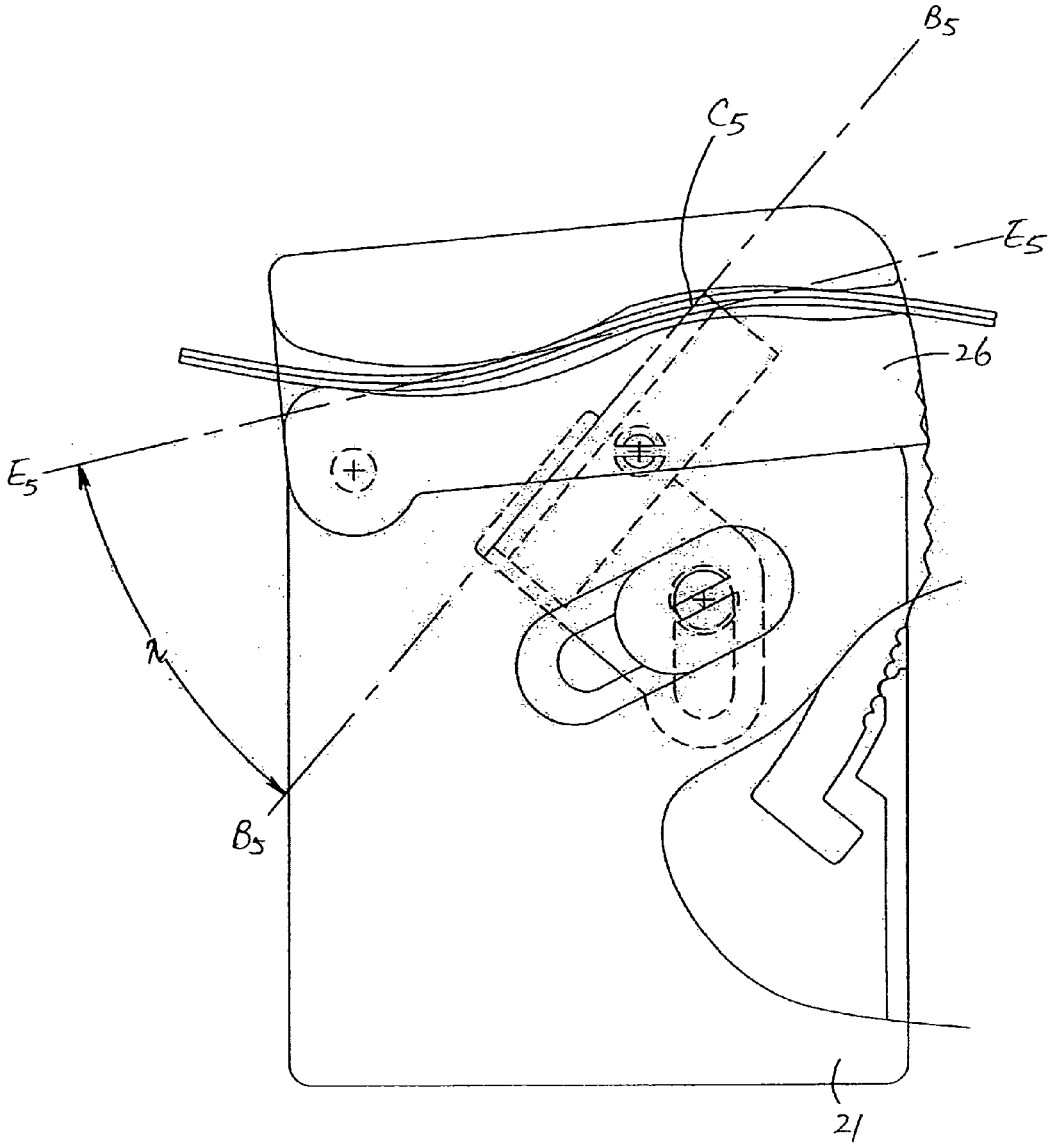
FIG. 11 is a top view of the letter opener shown in FIG. 10, with the head portion in a second position.
Figure 12:
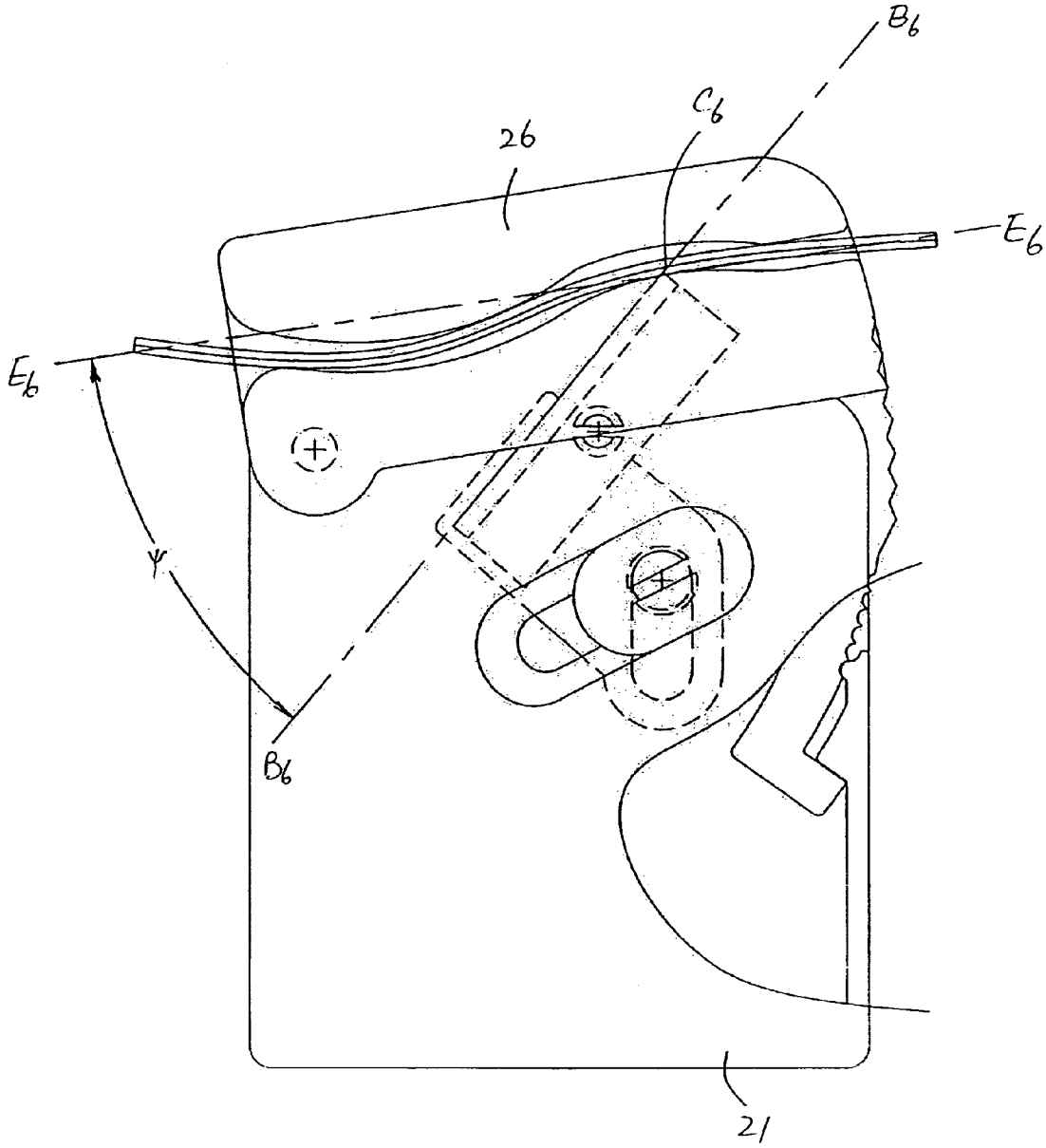
FIG. 12 is a top view of the letter opener shown in FIG. 10, with the head portion in a third position.

In the position as shown in FIG. 10, the head portion 26 is closest to the body part 21, in which the line $B_4$—$B_4$ is parallel to the longitudinal axis of the cutting blade 16, and the line $E_4$—$E_4$ is the tangent to the envelope E at the position $C_4$ where the cutting blade 16 cuts the envelope E. In FIG. 11, the head portion 26 is swivelled in an anti-clockwise direction relative to the body part 21, e.g. by a user acting on the first corrugated surface 52, such that the angle $\lambda$ between the lines $B_4$—$B_4$ and $E_4$—$E_4$ shown in FIG. 10 is larger than the angle $\lambda$ between the line $B_5$—$B_5$, which is parallel to the longitudinal axis of the cutting blade 16, and the line $E_5$—$E_5$, which is the tangent to the envelope E at the position $C_5$ where the cutting blade 16 cuts the envelope E. When the head portion 26 is swivelled further in an anti-clockwise direction relative to the body part 21 to the position shown in FIG. 12, the angle $\gamma$ between the lines $B_6$—$B_6$, which is parallel to the longitudinal axis of the cutting blade 16, and the line $E_6$—$E_6$, which is the tangent to the envelope E at the position $C_6$ where the cutting blade 16 cuts the envelope E, is smaller than the angle $\lambda$ between the lines $B_5$—$B_5$ and $E_5$—$E_5$.

It can be seen that, by way of the above-mentioned arrangement, a user may swivel the head portion 26 relative to the body part 21 to vary the position along the channel 42 at which the cutting blade 16 cuts the passing envelope E.

It should be understood that the above only illustrates an example whereby the present invention may be carried out, and that various modifications and/or alterations may be made thereto without departing from the spirit of the invention. For example, the letter opener 10 may be manually operated or electrically operated, and the cutting blade 16 may instead be a rotary cutter.

It should also be understood that various features of the invention are, for brevity, described here in the context of a single embodiment. Such features may, of course, be provided separately or in any appropriate sub-combinations.

What is claimed is:

1. A letter opener including a body member with a channel allowing an envelope to pass through, and a cutting member extending into said channel, wherein said body member and said cutting member are movable relative to each other to vary the position along said channel at which said cutting member cuts said passing envelope, and further including a carrier that engages said cutting member and that is movable relative to said body member by a button member that includes a pin member extending through a slot of said carrier.

2. A letter opener according to claim 1 wherein said button member is movable relative to said slot of said carrier to move said cutting member relative to said body member.

3. A letter opener according to claim 1 wherein said button member includes a pin member extending through a slot of said body member.

4. A letter opener according to claim 3 wherein said button member is movable relative to said slot of said body member to move said cutting member relative to said body member.

5. A letter opener including a body member with a channel allowing an envelope to pass through, and a cutting member extending into said channel, wherein said body member and said cutting member are movable relative to each other to vary the position along said channel at which said cutting member cuts said passing envelope, wherein said body member includes first and second parts which are swivellably movable relative to each other, and wherein said first part includes said channel.

6. A letter opener according to claim 5 wherein said first and second parts are swivellably movable relative to each other to vary the depth to which said cutting member extends into said channel.

7. A letter opener according to claim 5 wherein said first and second parts are swivellably movable relative to each other to vary the angle at which said cutting member cuts a passing envelope.

8. A letter opener according to claim 6 wherein said first part includes a digit engagement member operable to move said first part relative to said second part.

9. A letter opener according to claim 8 wherein said digit engagement member includes a plurality of recesses operatively associated with a protrusion of said second part for releasably positioning said first and second parts at different relative positions.

10. A letter opener according to claim 8 wherein said digit engagement member includes a stopper for limiting the extent of swivelling movement between said first and second parts.

11. A letter opener according to claim 7 wherein said first part includes a digit engagement member operable to move said first part relative to said second part.

* * * * *